US007910146B2

(12) United States Patent
Bravo Angulo

(10) Patent No.: US 7,910,146 B2
(45) Date of Patent: Mar. 22, 2011

(54) TOOL TO FACILITATE THE CONSUMPTION OF INGESTIBLE SUBSTANCES

(75) Inventor: Emilio Bravo Angulo, Fuengirola (ES)

(73) Assignees: Emilio Bravo Angulo, Fuengirola (ES); Aurora Fernandez Romero, Fuengirola (ES)

( * ) Notice: Subject to any disclaimer, the term of this patent is extended or adjusted under 35 U.S.C. 154(b) by 1125 days.

(21) Appl. No.: 11/630,327

(22) PCT Filed: Jun. 21, 2005

(86) PCT No.: PCT/EP2005/006671

§ 371 (c)(1), (2), (4) Date: Dec. 21, 2006

(87) PCT Pub. No.: WO2006/000376

PCT Pub. Date: Jan. 5, 2006

(65) Prior Publication Data

US 2008/0040862 A1 Feb. 21, 2008

(30) Foreign Application Priority Data

Jun. 24, 2004 (ES) ..... 200401530

(51) Int. Cl.
*B65D 81/34* (2006.01)

(52) U.S. Cl. ..... 426/110; 426/115; 30/123; 206/216; 206/223; 206/541

(58) Field of Classification Search ..... 30/124, 30/136, 136.5, 137, 141, 147, 148, 149, 150, 30/322, 324, 329, 338; 206/216, 223, 230, 541, 568, 570, 572; 426/106, 110, 115
See application file for complete search history.

(56) References Cited

U.S. PATENT DOCUMENTS 108,596 A * 10/1870 Hundley ..... 30/125
(Continued)

FOREIGN PATENT DOCUMENTS

DE 37 04 781 A1 9/1987
(Continued)

OTHER PUBLICATIONS

JP 02-196403, Iimuro Kenji, Machine translation, Aug. 1996.*
(Continued)

*Primary Examiner* — Rena L Dye
*Assistant Examiner* — Chaim Smith
(74) *Attorney, Agent, or Firm* — Sughrue Mion, PLLC

(57) ABSTRACT

Tool (1) to facilitate the consumption of ingestible substances, provided with a container (2) adapted to store an additional ingestible product (3), such as a food flavoring or a pharmaceutical product, and provided with an end (4) suitable to facilitate the handling of the ingestible substance (3) together with the additional product once this has been added to the ingestible substance (3), the container (2) comprising at least one end portion (5) constituted by a flexible, tearable material whereby the container (2) is joined to the tool body (6), designed to be torn when the container (2) is separated from the tool body (6), being able to pour its additional product content into the ingestible substance (3).

10 Claims, 2 Drawing Sheets

U.S. PATENT DOCUMENTS

| | | | | | |
|---|---|---|---|---|---|
| 2,505,122 | A | * | 4/1950 | Krieger, Jr. | 30/324 |
| 2,889,098 | A | * | 6/1959 | Durdan | 225/48 |
| 3,239,117 | A | * | 3/1966 | Letchworth | 225/32 |
| 3,428,460 | A | * | 2/1969 | Ely | 426/86 |
| 3,567,087 | A | * | 3/1971 | Schramm | 225/43 |
| 3,851,809 | A | * | 12/1974 | McKibbin | 225/20 |
| 3,993,220 | A | * | 11/1976 | Troy | 222/82 |
| 4,821,417 | A | * | 4/1989 | Levine | 30/298 |
| 4,891,232 | A | * | 1/1990 | Dahl | 426/78 |
| 5,975,305 | A | * | 11/1999 | Barger | 206/572 |
| 6,295,735 | B1 | | 10/2001 | Barger | |
| 2002/0092181 | A1 | * | 7/2002 | Choi | 30/324 |
| 2003/0232111 | A1 | * | 12/2003 | Sanso | 426/82 |

FOREIGN PATENT DOCUMENTS

| | | | |
|---|---|---|---|
| ES | 1 004 858 | U | 10/1988 |
| ES | 1 017 6109 | * | 1/1991 |
| ES | 1 017 619 | * | 1/1992 |
| JP | 07-052972 | * | 8/1993 |
| JP | 07-255581 | * | 10/1995 |
| JP | 08-196403 | * | 8/1996 |
| JP | 2003-135240 | * | 5/2003 |

OTHER PUBLICATIONS

JP 2003-135240, Tokinoya Tomohisa, Machine translation, May 2003.*

Examiner translation of ES 1 017 619 Sanchez et al., Jan. 1992.*

PTO translation Iimuiro JP—08-196403, Jun. 1996.*

PTO translation Tokinoya JP—2003-135240, May 2003.*

International Search Report for PCT/EP2005/006671, dated Oct. 5, 2005; and Preliminary Report on Patentability for PCT/EP2005/006671, dated Mar. 20, 2006.

* cited by examiner

TOOL TO FACILITATE THE CONSUMPTION OF INGESTIBLE SUBSTANCES

CROSS-REFERENCE TO RELATED APPLICATION

This application is a 371 of PCT/EP2005/006671, filed Jun. 21, 2005; the entire disclosure of which is incorporated herein by reference.

TECHNICAL FIELD OF THE INVENTION

The invention relates to a tool to facilitate the consumption of ingestible substances, of the type with a container which stores a flavouring product, to flavour food or drink, or a pharmaceutical product intended to be mixed with said ingestible substance.

BACKGROUND OF THE INVENTION

Document ES 1017619U discloses a device to package and/or supply food and/or pharmaceutical products manufactured preferably in plastic, comprised of an oblong body provided at its end with a widening which defines the bowl of a spoon. The oblong body has, at its other end, a prismatic widening which defines a receptacle wherein a food product such as sugar, coffee, jam, etc. is introduced. The oblong body has a weakened area to detach part of the receptacle from the rest wherein the bowl of the spoon is defined. Specifically, the part of the receptacle which is separated from the rest is formed by an easily opened sheet.

Document ES 1004858U discloses an improved single-use spoon, characterized in that it comprises a hollow control, determining a sugar containing receptacle, its volume adapted to one dose of this product, said receptacle being fully attached to the handle, i.e. extending from the proximities of the bowl to the free end thereof and finishing off at the end corresponding to the bowl in a small pouring orifice, whilst at its free end it is finished off in a large opening, which facilitates its filling and which is aided by the corresponding plug, wherein an air intake has been provided to facilitate the emptying.

In the aforementioned embodiments, the body or control of the device is configured to store a food or pharmaceutical product inside, so that the body acts as container. This involves an increase in the manufacturing cost of the device with these characteristics. Likewise, in the known embodiments the user of the device is not guaranteed that that this is going to be used for the first time as the containers can be filled more than once after their first use.

EXPLANATION OF THE INVENTION

The tool to facilitate the consumption of ingestible substances object of the invention, is of the type provided with a container adapted to store an additional ingestible product, such as a food flavouring or a pharmaceutical product, and they are provided with an end suitable to facilitate the handling of an ingestible substance together with the additional product once this has been added to the ingestible substance.

In essence, the tool of the invention is characterized in that the container comprises at least one end portion comprised of a flexible, tearable material whereby the container is joined to the body of the tool, intended to be torn on separating the container from the tool body, being able to pour its contents of additional product into the ingestible substance.

Thus, when the container is separated from the tool, the container stays irreversibly open on tearing it at the end portion that serves as connection to the tool body. Indeed, as the container cannot be separated from the tool without opening it, the join of the container to the tool according to the invention acts as a seal, as it guarantees that the user is the first to perform the action of separating the container from the tool.

In a preferred embodiment, one of the ends of the tool is provided with a groove, inside which is introduced, at least partially, the end portion of the flexible material of the container, which is adhered to either or both of the contact surfaces of the tool with the end portion of the container.

According to another preferred embodiment, the end portion of the container is embedded between a portion of the tool body and a second auxiliary body, solidly joined to the tool body and provided with means to favour the tearing of the end portion of the container.

According to another characteristic of the invention, the auxiliary body is provided with a perforated end area, which forms said means to favour the tearing of the end portion of the container.

In accordance with another characteristic of the invention, the auxiliary body is provided with at least one portion configured as a wedge, the corner of the acute angle thereof comprising the means to favour the tearing of the end portion of the container.

According to another characteristic of the invention, the end suitable to facilitate the handling of the ingestible substance is removably coupled to the tool body, meaning that it can be replaced or substituted with another end configured in a different form.

BRIEF DESCRIPTION OF THE DRAWINGS

The attached drawings illustrate, by way of non-limiting example, several preferred embodiments of the tool to facilitate the consumption of ingestible substances object of the invention. In said drawings.

DETAILED DESCRIPTION OF THE DRAWINGS

Figure 1:
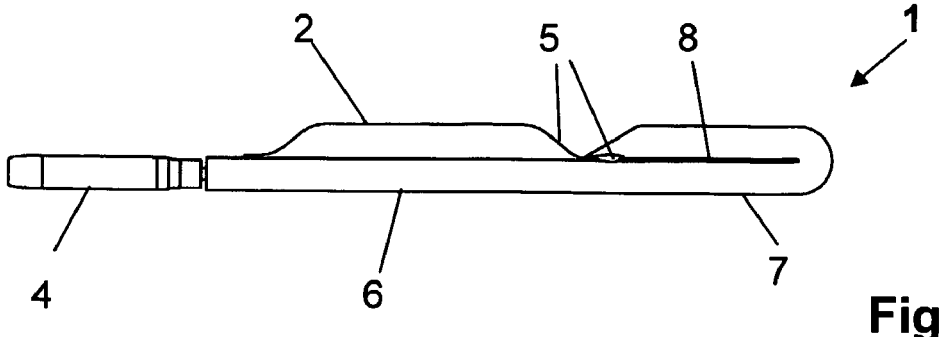
FIG. 1 is a side view of a first embodiment of the tool according to the invention.
Figure 2:
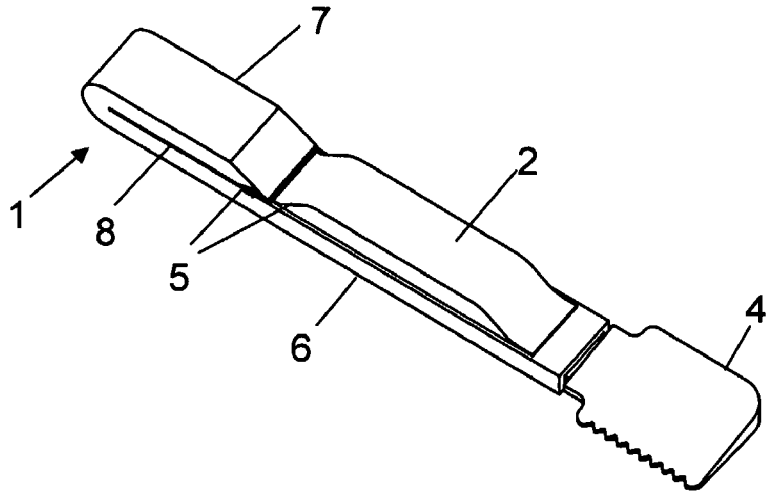
FIG. 2 is a perspective view of the tool of FIG. 1, wherein the container is joined to the tool body.
Figure 3:
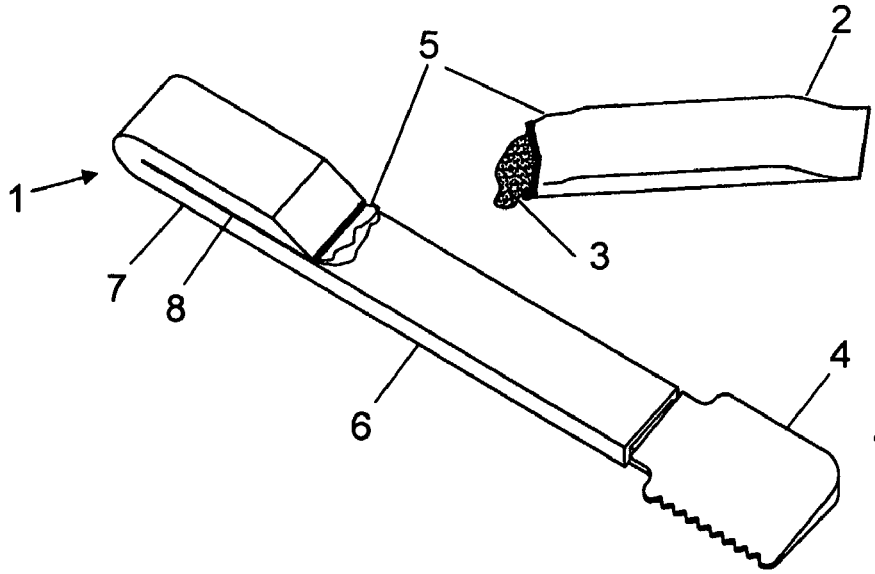
FIG. 3 is a perspective view of the tool of FIG. 1, wherein the container has been separated from the tool body, causing it to open.

The tool 1 represented in FIGS. 1 to 3 is provided with a container 2 which stores a food flavouring or a pharmaceutical product 3 (see FIG. 3). This container 2 may be manufactured and filled separately without it interfering in the slightest with the manufacturing of the tool 1 body 6.

The container 2 is formed from a flexible, tearable material, such as paper or plastic material, and its end portion 5 is introduced in the groove 8 that one end 7 of the tool 1 body 6 is provided with, also being solidly joined to said tool 1 body 6.

In FIG. 3 we can observe that the container 2, on separating from the tool 1 body 6 is broken off when you tear the end portion 5 thereof, which causes the container 2 to open, being able to pour its content of additional product 3 into the ingestible substance desired, whether solid or liquid. The end 4 of the tool 1 is further adapted to facilitate the handling of the ingestible substance or to optimize the mixture of the additional product with the ingestible substance. This end 4 may be in the form of a spoon, knife, fork or it can be a simple spatula which can be used to dissolve the additional product 3 in a liquid.

Said end 4 of the tool 1 is removably coupled to the tool 1 body 6, e.g. by pressure, in a known way, meaning that this end may be replaced by another end 4 configured in another form, depending on the use one wants to give it.

Figure 4:
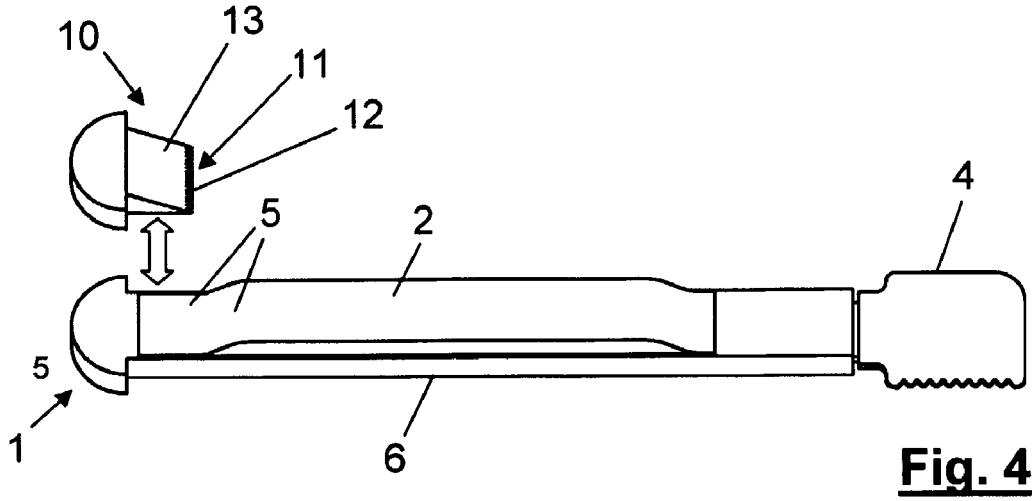
FIG. 4 is a perspective view of a second embodiment of the tool object of the invention, wherein the different parts that comprise it are separated.
Figure 5:
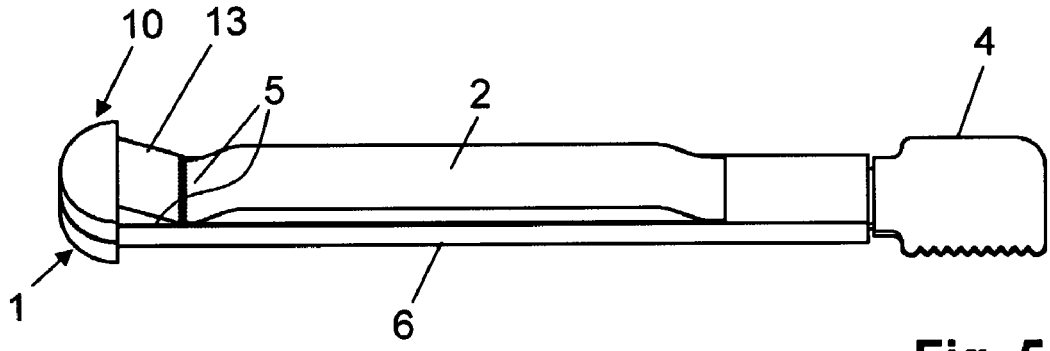
FIG. 5 is a perspective view of the tool of FIG. 4, wherein the different parts that comprise it are joined together.

In the example of FIGS. 4 and 5, the tool 1 comprises an auxiliary body 10, originally separated from body 6 of the tool (FIG. 4), designed to be fixed to the body 6 of the tool (as indicated in the arrows of FIG. 4), the end portion 5 of the container 2 being interposed between said auxiliary body 10 and the tool 1 body 6 (FIG. 5). Thus, simply and economically, a tool 1 is produced provided with a container 2 so that the consumer can be provided at the same time with a utensil to stir or handle an ingestible substance and the dose of an additional product stored in the container 2.

As the end portion 5 of the container is comprised of a flexible, tearable material, when you try to separate the latter from the tool 1 body 6 it causes the container to break, causing it to open.

As is shown in FIGS. 4 and 5, the auxiliary body 10 is provided with means which favour the breaking of the container 2. Indeed, the auxiliary body 10 is provided with a perforated end area 12 designed to cause one or several cuts in the end portion 5 of the container, thus facilitating the subsequent tearing thereof. Likewise, said end portion of the auxiliary body 10 of FIGS. 4 and 5 is in the form of a wedge 13, the corner thereof contributing to the breaking of the container 2 when this is separated from the tool 1 body 6.

Figure 6:
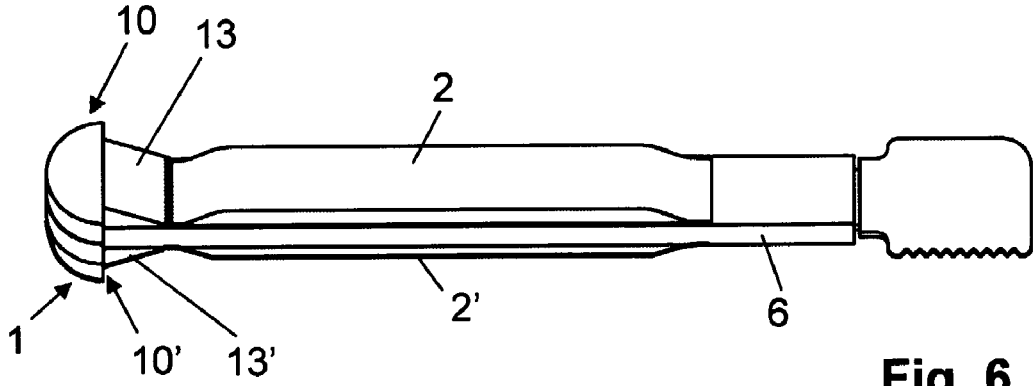
FIG. 6 is a perspective view of a third embodiment of the tool object of the invention, provided with two containers.

The tool represented in FIG. 6 is provided with two similar containers 2 and 2', arranged with each one resting on one of the sides of the tool 1 body 6. Unlike the variants of FIGS. 4 and 5, the tool of FIG. 6 comprises two auxiliary bodies 10 and 10' solidly joined to retain the containers 2 and 2', respectively. According to this variant, the product stored in each container may be different, meaning that the versatility of the tool object of the invention is even greater. Each one of the auxiliary bodies 10 and 10' is in the form of a wedge 13; 13' to tear the containers 2 and 2' when they are separated from the body 6 of the tool. Naturally, if the auxiliary bodies 10 and 10' are provided with means to facilitate tearing the containers, such as a serrated configuration, said means may be different to one another, each auxiliary body being adapted to the characteristics of the container it holds, which vary in accordance with the product stored therein.

It is also designed that the containers 2; 2' may be compartmentalized, meaning that one container can store more than one product without them being mixed before pouring them into the drink or the food, if they are flavouring products, or preparing the solution if they are pharmaceutical products.

Despite the fact that here reference is made to ingestible products, it is understood that, without altering the technical characteristics of the tool claimed, the container can store non-ingestible products, designed to be mixed with the aid of the end 4 of the tool 1, to prepare the solutions, pastes or other type of mixtures intended for other uses, such as manufacturing glues, varnishes, paints, chemical products in general, etc.

The invention claimed is:

1. A tool to facilitate the consumption of ingestible substances, said tool adapted to store an additional ingestible product, wherein said additional product is provided in a separate container and said tool is provided with an end suitable to facilitate the handling of the ingestible substance together with the additional product once the additional product has been added to the ingestible substance, wherein the container comprises at least one end portion formed from a flexible, tearable material whereby the container is joined to a body of the tool and designed to be torn when the container is separated from the tool body thereby, being able to pour the additional product from the container into the ingestible substance;

wherein one end of the tool is provided with a groove, wherein is introduced, at least partially, the end portion of flexible material of the container, and said end portion is adhered to either one of the contact surfaces of the groove.

2. A tool to facilitate the consumption of ingestible substances, said tool adapted to store an additional ingestible product, wherein said additional product is provided in a separate container and said tool is provided with an end suitable to facilitate the handling of the ingestible substance together with the additional product once the additional product has been added to the ingestible substance, wherein the container comprises at least one end portion formed from a flexible, tearable material whereby the container is joined to a body of the tool and designed to be torn when the container is separated from the tool body, thereby being able to pour the additional product from the container into the ingestible substance;

wherein the end portion of the container is embedded between a portion of the tool body and a second auxiliary body, solidly joined to the tool body and provided with means to favour the tearing of the end portion of the container.

3. The tool according to claim 2, wherein the auxiliary body is provided with a serrated end area, which constitutes said means to favour the tearing of the end portion of the container.

4. The tool according to claim 2, wherein the auxiliary body is provided with at least one portion configured by way of a wedge, the corner of the acute angle thereof constituting the means to favour the tearing of the end portion of the container.

5. The tool according to claim 1, wherein the ingestible product is food flavouring or a pharmaceutical product.

6. The tool according to claim 1, wherein the end suitable to facilitate the handling of the ingestible substance is detachably coupled to the tool body and replaceable by a different end that also facilitates the handling of the ingestible substance.

7. A tool to facilitate the consumption of an ingestible substance, comprising:

a tool body having a first end and a second end;

a container comprising an additional ingestible product;

the first end of the tool body configured to facilitate application or mixing of the additional ingestible product to the ingestible substance;

the container comprises a portion formed from a tearable material joined to the tool body and configured to be torn when the container is separated from the tool body, thereby opening the container to allow dispensing of the additional ingestible product; and a groove in the tool body in which the portion of the container formed from the tearable material is at least partially inserted and said portion is held by one or both of the interior contact surfaces of said groove.

8. A tool to facilitate the consumption of an ingestible substance, comprising:

a tool body having a first end and a second end;

a container comprising an additional ingestible product;

the first end of the tool body configured to facilitate application or mixing of the additional ingestible product to the ingestible substance;

the container comprises a portion formed from a tearable material joined to the tool body and configured to be torn when the container is separated from the tool body, thereby opening the container to allow dispensing of the additional ingestible product;

wherein the portion of the container formed from the tearable material is embedded between the tool body and a second auxiliary body, solidly joined to the tool body and provided with an edge to facilitate the tearing of the portion of the container formed from the tearable material.

9. The tool according to claim 8, wherein the edge of the second auxiliary body is serrated.

10. The tool according to claim 7, wherein the first end of the tool body is removably coupled to the tool body and replaceable with another end configured to facilitate handling of the ingestible substance together with the additional product once the additional product has been added to the ingestible substance.

* * * * *